US005829170A

United States Patent [19]

Lutz, Jr.

[11] Patent Number: 5,829,170

[45] Date of Patent: Nov. 3, 1998

[54] PROTECTIVE COVER FOR AN ICE HOCKEY SKATE

[76] Inventor: John F. Lutz, Jr., 3210 Waterford Ct. # 1004, Rochester Hills, Mich. 48309

[21] Appl. No.: 852,544

[22] Filed: May 7, 1997

[51] Int. Cl.[6] ..... A43B 13/22

[52] U.S. Cl. ..... 36/72 R; 36/7.1 R

[58] Field of Search ..... 36/7.1 R, 11.5, 36/72 R, 7.2, 133

[56] References Cited

U.S. PATENT DOCUMENTS

| | | | |
|---|---|---|---|
| 1,640,669 | 8/1927 | Sankey | 36/72 R |
| 1,742,763 | 1/1930 | Gerard | 36/72 R |
| 3,040,455 | 6/1962 | Criswell | 36/72 R |
| 3,271,888 | 9/1966 | Graham et al. | 36/72 R |
| 3,806,145 | 4/1974 | Czeiszperger . | |
| 3,812,606 | 5/1974 | Merola | 36/72 R |
| 4,333,248 | 6/1982 | Samuels . | |
| 4,351,537 | 9/1982 | Seidel . | |
| 4,445,287 | 5/1984 | Garcia | 36/72 R |
| 4,967,493 | 11/1990 | Mues . | |
| 4,991,318 | 2/1991 | Cornell . | |
| 5,060,581 | 10/1991 | Malinski | 108/44 |
| 5,060,976 | 10/1991 | Boone | 280/801 |
| 5,103,537 | 4/1992 | Snyder et al. | 24/198 |
| 5,234,230 | 8/1993 | Crane et al. . | |
| 5,445,585 | 8/1995 | Meeker | 482/69 |
| 5,566,476 | 10/1996 | Bertrand et al. . | |

FOREIGN PATENT DOCUMENTS

| | | | |
|---|---|---|---|
| 723397 | 9/1931 | France | 36/72 R |
| 361341 | 11/1921 | Germany | 36/72 R |
| 2253128 | 9/1992 | United Kingdom | 36/72 R |

*Primary Examiner*—M. D. Patterson
*Attorney, Agent, or Firm*—Vanophem Meehan & Vanophem, P.C.

[57] ABSTRACT

A protective cover for use in covering a portion of an ice hockey skate, the protective cover having a first portion covering a front tongue portion of the skate, a second portion covering an inside portion of the skate and a third portion covering an outside portion of the skate. The protective cover is a relatively thin, constant thickness layer made of a thermoplastic material, such as polycarbonate, and includes a plurality of straps having a hook and loop material thereon for fastening the protective cover to the skate. The straps each have a pad on one end thereof and located between the skate and the protective cover to create a gap therebetween and the straps each extend through a respective hole in the cover to fasten appropriately. A method for manufacturing and attaching the protective cover to the skate is also disclosed.

6 Claims, 3 Drawing Sheets

FIG-4
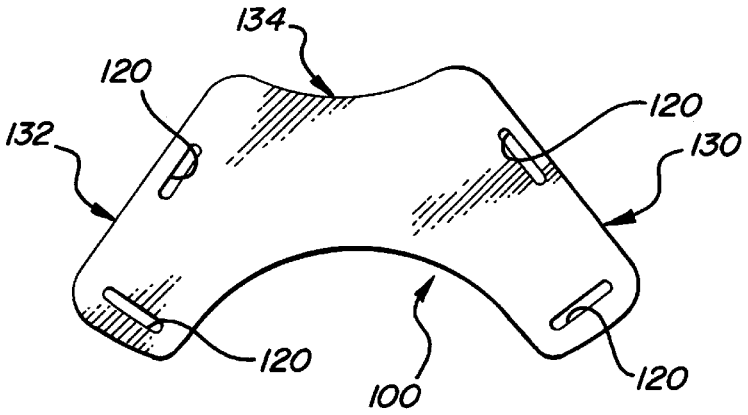
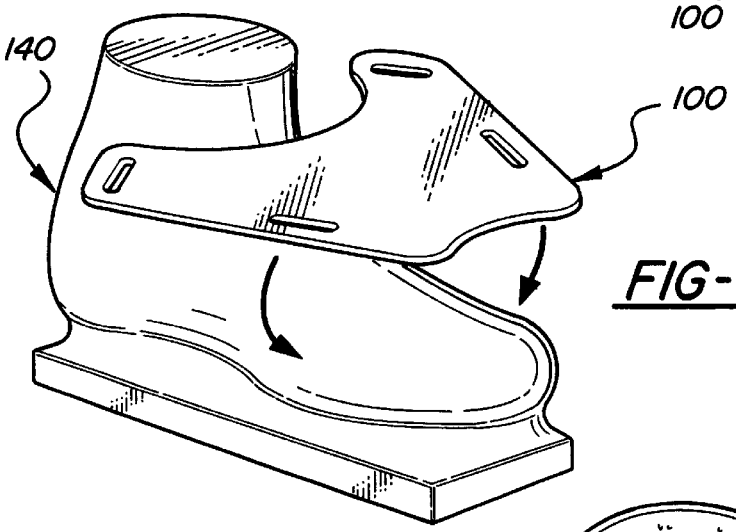
FIG-5
FIG-6
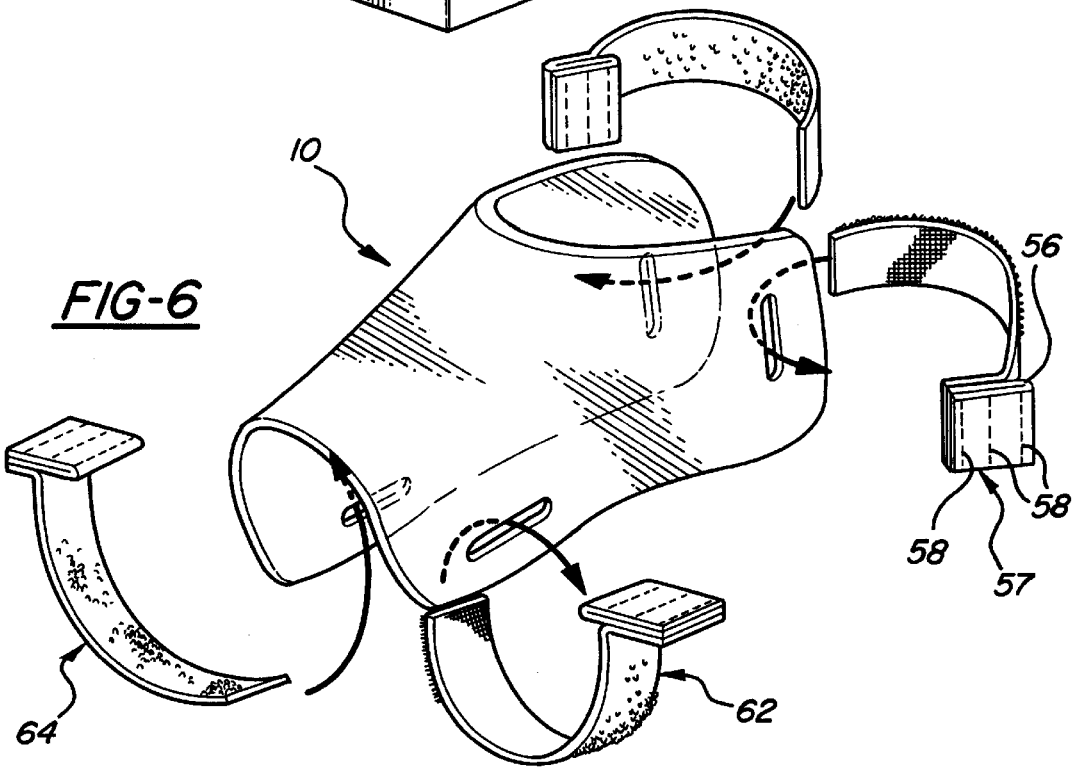

20
23
19
G
G
G
27
12
14
26
27
27

PROTECTIVE COVER FOR AN ICE HOCKEY SKATE

BACKGROUND OF THE INVENTION

1. Field of the Invention

The present invention generally relates to a protective device, and a method of manufacture therefor, worn as a cover over a portion of a leather upper of an ice hockey skate. More particularly, the present invention relates to a relatively thin and lightweight thermoplastic cover placed over the front, sides and ankles of a hockey skate to prevent injuries.

2. Description of the Prior Art

Ice hockey has been a competitive sport since the mid 1800's. Ice hockey is a game in which a frozen piece of hard rubber (i.e., a puck) is slapped about by players with a hockey stick in an attempt to put the puck in the opposing team's goal. By its very nature, ice hockey is a very fast paced, unpredictable and aggressive sport.

Ice skating by itself is a very popular recreational activity and has been popular since the 1800's. Before the advent of indoor ice arenas, it was only possible to skate outdoors where it was cold enough to make the necessary ice. Because it was cold enough to make ice, it was quite cold for the people ice skating. To compensate for the cold felt by the people skating, many devices were invented to keep a person's foot warm and protect it from the harsh cold weather. Many examples of such skate warmers exist. However, these prior art devices are designed solely to keep a skater's foot warm and not to protect it from contact by a potentially harmful object.

The prior art devices provide little protection from a puck being shot into the side or front of the player's foot. These references completely fail to address the problems associated with protecting the foot from an impact type contact resulting in a bruised or broken bone.

An ice hockey puck is made from rubber that is frozen prior to play. The puck is passed and shot by players at speeds in excess of 100 miles per hour. The puck is a very hard and dangerous instrument. While it has been known for some time that a hard hit puck can break bones in a player's foot, even though the player's skate is padded, very little has been proposed to prevent such an injury from occurring. Hockey sticks, made of hardwood and aluminum, are swung by players in an attempt to hit the puck. They can hit the feet of a player resulting in impact injuries to the foot including, but not limited to, soft tissue bruising, bruising of the bone and fractures.

There have been some attempts in the prior art to help prevent injuries to an athlete's feet, because foot injuries are not entirely unique to ice hockey. One type of prior art device relates to baseball. Because of the propensity for a baseball to be fouled off toward the batter's feet, ball players have been known to wear protectors to prevent injury to their feet and ankles. For example, U.S. Pat. No. 5,566,476, to Bertrand et al., discloses a releasably attached, soft padded foot and ankle protector designed to cover the top of the player's foot and inside ankle. Other examples include U.S. Pat. No. 4,333,248, to Samuels; U.S. Pat. No. 4,967,493, to Mues and U.S. Pat. No. 4,991,318, to Cornell. While known to provide at least some protection to the player's feet, the prior art devices have proven to be insufficient and lacking in several aspects, in that they do not address the unique needs of hockey players. Thus, there continues to be a significant need for a device that will adequately protect a hockey player's feet during play.

Some devices have been designed specifically for skates. For example, U.S. Pat. No. 3,806,145, to Czeiszperger, discloses an external guard for a goalie's ice hockey skate. In particular, Czeiszperger discloses that the guard is made of a plastic material and covers the cap toe of the skate, the inner and outer sides of the skate, and the back and inner and outer sides of the ankle portion of the skate. Czeiszperger also discloses that strips of pressure-sensitive type weather stripping material are located between the outer cover and the skate to provide a protective space between the guard and the skate.

Czeiszperger discloses that the guard has an inwardly extending lip under the bottom portion of the skate. The lip is used to attach the guard to the skate by rivets or other attaching means. The Czeiszperger guard also adds significant weight to the ice hockey skate, which is why the Czeiszperger guard is only worn by goalies who do not have to aggressively skate up and down the ice rink.

In addition to the Czeiszperger reference, U.S. Pat. No. 5,234,230, to Crane et al, the disclosure of which is incorporated herein by reference, discloses an ankle and foot protector device for attachment to an ice hockey skate. Crane et al disclose that the skate guard has at least one support layer and a protective pad attached to the support layer. Crane et al disclose that the support layer is made of a flexible material termed "ballistic" nylon cloth and that the protective pad is formed from flexible sheets of high impact-resistance foam covered with ballistic nylon cloth and having between a ¼ inch and ¾ inch thickness. Alternatively, Crane et al teach that a more rigid protective shield may be attached to the support layer. Crane et al disclose and teach a protective guard that is structurally complex and too heavy for the amount of protection it provides.

U.S. Pat. No. 4,351,537, to Seidel, the disclosure of which is incorporated herein by reference, discloses and teaches a multipart skate having a hockey boot made from a molded plastic. Seidel teaches the skate also includes a sole portion of the hockey skate having first and second support portions for supporting the blade of the skate. Seidel discloses and teaches that a player puts a foot in a foam rubber inner sock that then has its toes and heel placed in the first and second support portions, respectively. Next, the removable cover portion fully encloses the sock to completely enclose the foot, provide protection and secure the ice hockey skate.

The cover portion of the Seidel device is made of a molded plastic designed to fit closely to the sock to properly hold the skate to the player's foot. The Seidel reference discloses and teaches that the cover portion has a plurality of ribs forming a flexible portion necessary for allowing the angle between the shin and the player's foot to change. Seidel also discloses and teaches a particular fastener for connecting the cover portion to the sole portion of the skate.

The ice hockey skate of the Seidel reference is very bulky and heavy due to its design. Further, because there is no leather upper, it is not possible to achieve the desired fit of the ice hockey skate to the foot. Further, the cover portion of the ice hockey skate of the Seidel reference must contain a flexible portion or it will not be possible for the player to skate, further adding to the complexity, cost and weight of the skate.

None of the prior art references appreciate the need to sufficiently protect the player's foot while maintaining an acceptable weight to protection ratio. The prior art references are primarily made of relatively soft and spongy materials. These relatively soft and spongy materials are undesirable due to their undesirable weight to protection ratios for the present application to the skate where weight considerations dominate. To obtain an appropriate amount of protection, a significantly increased thickness must be used resulting in a heavy protector on a player's foot, such as taught by the Crane reference. The ice hockey player must then exert extra energy, will tire more quickly and be slowed. In a game where speed is critical, most players will risk potential injury rather than be slowed. Thus, there continues to be a significant need for a device which will adequately protect the foot and ankle of an ice hockey player while adding a minimum of weight to the ice hockey skate.

Furthermore, there continues to be a long felt need for an ice hockey skate guard that will protect the player's foot from injury due to a hockey puck, wherein the device is easily and quickly attached to the skate and is relatively inexpensive to manufacture. The Crane et al reference although protective is relatively expensive to manufacture and unacceptably heavy. Further, the Crane et al device is not easily and quickly attached and detached from the skate. This is particularly problematic since a user wanting to remove the entire device, must unlace the skate to remove the guard. Crane et al teach that the entire lace must be removed to detach the guard. Similarly, the Czeiszperger invention is riveted to the bottom of the skate and thus cannot be removed without removing the rivets.

The Crane et al device presents a further problem in that the front portion of the skate is protected by a removable pad attached to the support layer by a hook and loop fastener. Since the pads taught by Crane elal have a significant thickness, it is likely that the front cover portion may be inadvertently detached from the support layer during a game of ice hockey interrupting play and eliminating the effectiveness of the device. In addition, the Crane et. al. device is a relatively wide profile device which will cause a skater to catch his feet while trying to skate and lose an edge while making sharp turns.

SUMMARY OF THE INVENTION

The present invention resides in a relatively very lightweight protective cover or shroud to be placed over the leather upper of an ice hockey skate. The protective cover includes a relatively uniformly thick thermoplastic sheet material having a predefined shape to correspond to the top of an ice hockey skate having a leather upper. The protective cover of the present invention covers the top portion, inside portion and outside portions of the skate, including the ankle. The protective cover of the present invention is designed to be easily and efficiently attached and detached to the ice hockey skate. The protective cover of the present invention is an inexpensive, user friendly solution to a problem made too complex by prior art solutions.

The attachment device according to the present invention is uniquely designed to keep the cover of the present invention slightly spaced from the upper of the ice hockey skate such that there is a gap which helps absorb the shock of an impact from an ice hockey puck or stick. The present invention also includes a method of manufacturing the relatively lightweight protective cover according to the present invention.

It is an object of the present invention to provide an ice hockey player with adequate foot protection to prevent injuries from objects (e.g. a puck or a stick) impacting the player's foot within the hockey skate.

It is a further object of the present invention to provide a relatively very lightweight and protective cover having a constant thickness, the cover being placed over the top and side portions of an ice hockey skate to absorb impacts resulting from objects striking the protective cover.

It is yet another object of the present invention to provide a protective cover for a skate, the cover having a predefined shape.

It is yet another object of the present invention to provide a protective cover for a skate wherein the cover is easily and efficiently attached and detached to the skate.

It is yet another object of the present invention to provide a protective cover for a skate wherein the cover includes an attachment device which is a hook and loop fastener, such as Velcro®.

It is yet another object of the present invention to provide a protective cover for a skate wherein the attachment device provides a gap between the protective cover and the skate that dissipates impacts without the force being transferred to the player's foot.

It is still a further object of the present invention to provide a protective cover for a skate wherein the attachment device includes a space between the cover and the upper of the skate to define a continuous gap therebetween to provide significant protection to the player and the protective cover is relatively inexpensive to manufacture due to its simplified design.

These and other objects of the present invention will become readily apparent from the drawings of the present invention as briefly described below taken in conjunction with the following detailed description of the preferred embodiment of the present invention.

BRIEF DESCRIPTION OF THE DRAWINGS

FIG. 4 is a plan view of a cover blank prior to forming according to the preferred embodiment of the present invention detailing the manufacturing process of the protective cover.

FIG. 5 is a perspective view further detailing the manufacturing process of the present invention wherein the cover blank is formed over a skate blank.

FIG. 6 is a perspective view further detailing the manufacturing process of the present invention wherein the straps are formed and assembled to the formed protective cover.

DETAILED DESCRIPTION OF THE PREFERRED EMBODIMENT

Figure 1:
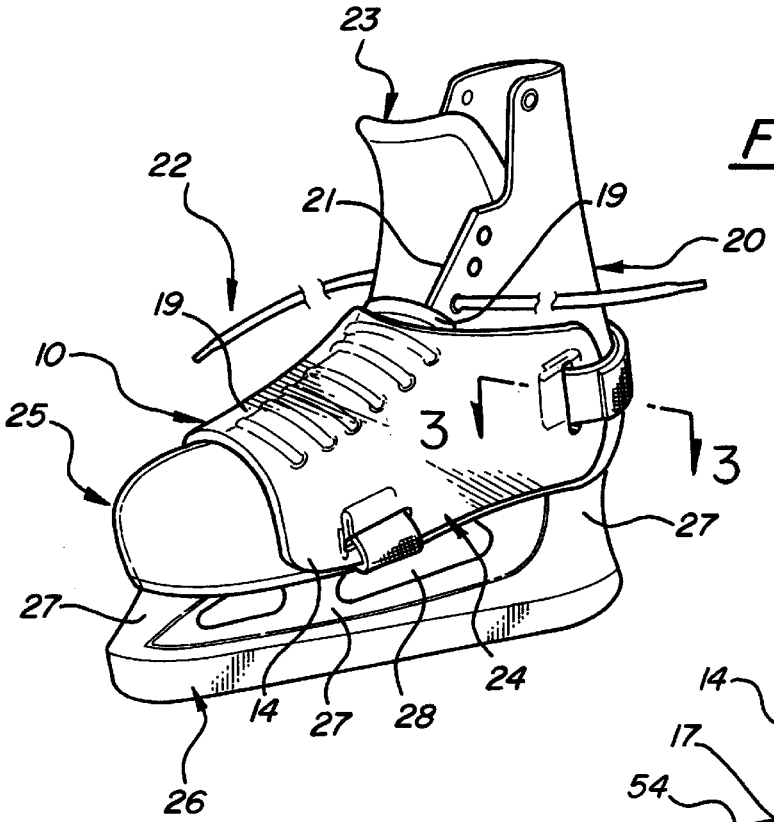
FIG. 1 is a front, side perspective view of a preferred embodiment of the protective cover of the present invention placed on an ice hockey skate.
Figure 2:
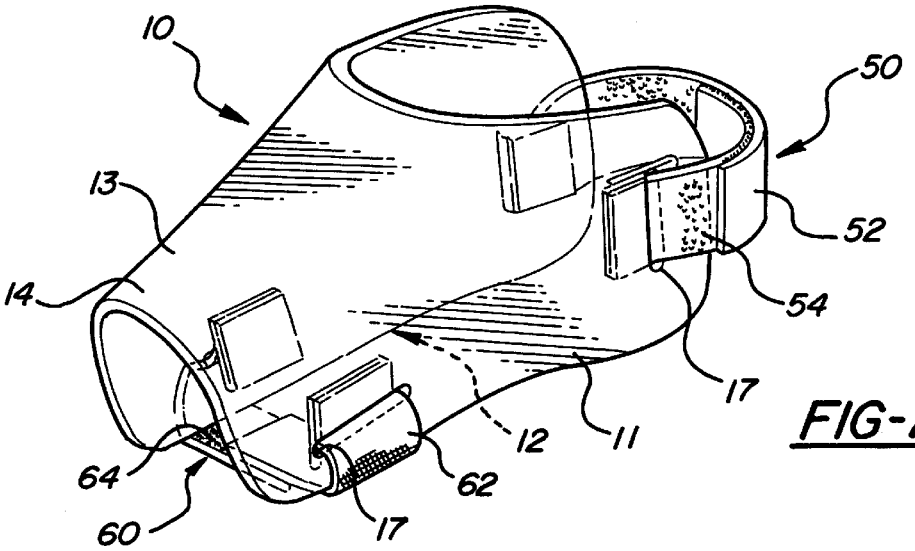
FIG. 2 is a front, side perspective view of the preferred embodiment of the protective cover of the present invention detailing the attaching straps.

Referring generally to the drawings and particularly to FIG. 1 and FIG. 2, there is shown an ice hockey skate protective cover or shroud 10 attached to an ice hockey skate 20 according to the present invention. In the present invention, protective cover 10 is intended to mean only a protective cover that is placed over a complete ice skate 20 and does not make up a part of the ice skate 20. Furthermore, in the present invention the word protective is intended to mean that the cover protects primarily against impact forces against the ice skate that may cause injury to the player's foot located in the skate 20.

The cover 10 of the present invention is shown to closely form fit with the skate 20 and cover a substantial portion of an upper 21. The upper 21 of the skate 20 is typically made of leather and usually has a plurality of pads integrally formed therewith and strategically located within the upper to form fit the upper 21 to a foot located therein. Most leather upper skates are designed to become form fitting over time with the aid of moisture, typically in the form of sweat excreted through glands in the skin, which makes the normally dry and stiff leather form fitting to the player's foot located within the skate 20.

Thus, the upper 21 fits closely to the player's foot. However, this close-fitting feature causes impact forces to be directly transferred to the foot. The upper 21 is normally internally padded. However, because of the extreme forces encountered during play, this padding is often insufficient to avoid pain and severe injury to the flesh, muscle and bone of the player. Thus, the protective cover or shroud 10 is preferably manufactured from a relatively very hard and stiff material, such as polycarbonate. Preferably, a transparent material is used for the cover 10. The polycarbonate material is preferable because it is a virtually unbreakable, impact resistant material. Polycarbonate also has sufficient temperature resistance, is readily thermoformed to complex shapes and is easily stamped or machined to a preferred shape. Furthermore, polycarbonate is one-half the weight of glass and forty-three percent (43%) lighter than aluminum and comes in transparent and colored forms.

The skate 20 includes a front portion 22 which primarily includes the tongue 23 of the skate 20 and a lace 19. The skate includes a first side 24 and a second side 25, it being understood that either the first side 24 or second side 25 may be the inside and/or outside of the skate 20. Accordingly, if the skate 20 as shown is intended to be placed on a player's right foot, the first side 24 will be the inside and the second side 25 will be to the outside. If the skate 20 is designed to be placed on the player's left foot, it will be opposite. The skate 20 also includes a blade 26 as is well known. The blade 26 is connected to the skate 20 using posts 27 that connect the blade 26 to the bottom of the skate 20. The posts 27 define holes 28 therebetween.

The protective cover 10 has a first portion 11 that corresponds to and covers the first side 24 of the skate 20, a second portion 12 that corresponds to and covers the second side 25 of the skate 20 and a third portion 13 that corresponds to and covers the front portion 22 of the skate, the third portion 13 being located between the first and second portions 11 and 12, respectively. The front portion 22 includes the tongue 23 and the lace 19 of the skate 20. Very significantly, the first portion 11, second portion 12 and third portion 13 of the cover 10 are preferably, unitarily formed as a single layer 14 having a substantially constant thickness. Because the cover 10 is unitarily formed as a single piece, it is more capable of efficiently dissipating impacts received from pucks, sticks and other items. Thus, the cover 10 of the subject invention is solely designed to be a single unitary piece.

The protective cover 10 is attached to the skate 20 using very particular and uniquely designed straps having hook and loop fasteners appropriately located thereon. The cover 10 is secured to the skate 20 using a first fastener pair 50 and a second fastener pair 60. The first fastener pair 50 is aligned with the heel of the foot below the Achilles' tendon at the rear of the skate 20 and includes a first strap 52 having hook material thereon and a second strap 54 having a loop material thereon such that the first strap 52 and second strap 54 will be connected once they are placed in contact at the back of the skate 20.

Similar to the first fastener pair 50, the second fastener pair 60 has a first strap 62 having a hook material thereon and a second strap 64 having a loop material thereon such that the first strap 62 and second strap 64 will be connected once they are placed in contact in the hole 28 between the posts 27 at the bottom of the skate 20. The hook and loop material may be any appropriate material which will releasably attach the first straps 52 and 62 to the second straps 54 and 64, respectively, and will not become detached during normal use. An appropriate hook and loop material includes the commonly known Velcro® material or similar material.

Figure 3:
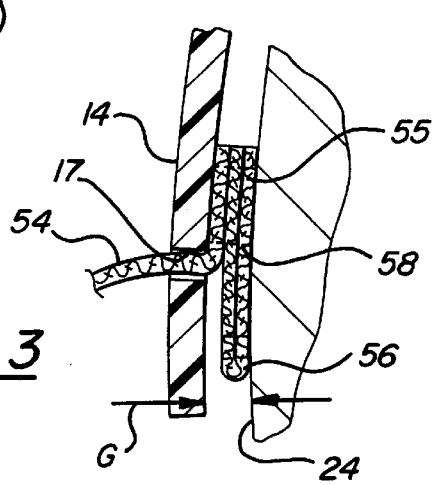
FIG. 3 is a section view taken along the line 3—3 in FIG. 1 detailing the attaching strap and connection of the protective cover of the preferred embodiment of the present invention to the ice hockey skate.

Each strap 52, 54, 62 and 64 is connected in a respective hole 17 in the protective cover 10 in a similar fashion and therefore will be described in detail for only the strap 54 as shown in FIG. 3. The strap 54 has a first portion end 55 folded onto itself to create a fold 56 that constitutes an end pad 57 held together by sewing the fold 56 at the threads 58. The strap 54 is connected to the end pad 57 by sewing the strap 54 to the end pad 57 using the threads 58. The end pad 57 is made of a nylon backed material to increase the thickness of the end pad 57 and create a gap G between the single layer 14 of the cover 10 and the first side 24 of the skate 20. The gap G extends nearly uniformly and completely between the skate 20 and the single layer 14 of the cover 10.

The gap G is defined in the front portion 22 between the tongue 23 of the skate 20 by the lace 19 of the skate 20 that is wound through the eyelets of the skate 20. Accordingly, the cover 10 of the present invention takes advantage of the lace 19 of the skate 20 to help define the gap G between the single layer 14 of the cover 10 and the skate 20 at the front portion. The gap G provides an extra layer of protection and dissipates impact forces to the external surface of the single layer 14 of the cover 10.

The holes 17 are positioned on the layer 14 such that the protective cover 10 is held on with only two fastener pairs 50 and 60, using the force of the first and second fastener pairs 50 and 60 to bias the single layer 14 against the lace 19 on front portion 22 of the skate 20. The result is the protective cover 10 for the skate 20 can withstand very significant blows and impacts with excellent protection of the player's foot in the skate 20. Furthermore, the protective cover 10 of the present invention is relatively simple to attach and detach from the skate 20, very lightweight, preferably under five ounces (5 oz.), and very inexpensive to manufacture. Furthermore, the polycarbonate material which constitutes the single layer 14 can be made of any color or clear and can be easily printed with logos and trademarks for advertising purposes.

The protective cover 10 of the present invention is manufactured using a unique process. The single layer 14 of the cover 10 is first formed as a flat cover blank 100, see FIG. 4, using preferably a single stamping or machining operation. The cover blank 100 is formed in a predefined size and having a generally W-shaped appearance. The cover blank 100 may be formed using any process including injection molding, machining, casting, etc. The cover blank 100 preferably is formed to include four slots 120 corresponding to the holes 17. The slots 120 will be used with the straps of the fastener pairs 50 and 60 to hold the protective cover 10 to the skate 20.

The predefined shape of the cover blank 100 includes a first leg portion 130 corresponding to the first portion 11 and will eventually cover the first side 24 of the skate 20. The cover blank 100 also includes a second leg portion 132 corresponding to the second portion 12 corresponding to the second or opposite side 25 of the skate 20 and a middle or third portion 134 for covering the front portion 22 and tongue 23 of the skate 20. The cover blank 100 and, necessarily, the single layer 14 of the protective cover 10, are formed of a single, cohesive, unitary piece having a relatively constant thickness. The thickness of the cover blank 100 is chosen to optimize (in particular, minimize) the weight of the protective cover 10 while still providing sufficient and adequate protection to the player's foot. In particular, the thickness of the polycarbonate material cover blank 100 is chosen to be 0.093" thick. This particular thickness has proven to provide adequate protection to the player's foot while still providing a protective cover 10 that is less than five ounces in weight. Further, the particular thickness is advantageous because it is readily available off-the-shelf from polycarbonate sheet material manufacturers.

Once the cover blank 100 is formed during the stamping operation, the cover blank 100 is heated so the polycarbonate cover blank 100 can be formed to a shape complementary to a mold 140 that approximates the shape of the ice hockey skate 20. In order to obtain as good a form as possible it is preferable to have the mold 140 heated to an appropriate temperature to cause the cover blank 100 to form as close as possible to the mold 140. The mold 140 is formed to be specific to a player's right foot or left foot and includes curved surfaces corresponding to the arch of the foot.

The mold 140 is made in different sizes to correspond to differently sized cover blanks 100 for correspondingly sized feet and skates 20. In particular, it is estimated that a single mold 140 can be used to make a protective cover 10 that will correspond to a range of skate sizes. Preferably, each mold 140 corresponds to at least two skate sizes by having the mold 140 sized to the middle size of the range and then taking advantage of the pliable nature of the material used to make the single layer 14.

Once the cover blank 100 is formed to the mold 140, it is pulled from the mold 140 and allowed to cool to room temperature. Either before, during or after the forming of the cover blank 100, the straps 52, 54, 62 and 64 are formed. By example using strap 54, all of the straps are formed by folding the first end portion 55 over to create the fold 56 to create the end pad 57. Optionally a second fold 56 can be made, and then the fold(s) 56 are stitched with the threads 58 using any appropriate sewing technique or machine. Furthermore, the fold(s) 56 may be made permanent using other techniques or structure such as staples, glue or other fastening means. The strap 54 is connected to the the pad 57 during the sewing or fastening step for making the end pad 57. Alternatively, the strap 54 is attached to the end pad 57 after the end pad 57 is made.

Figure 7:
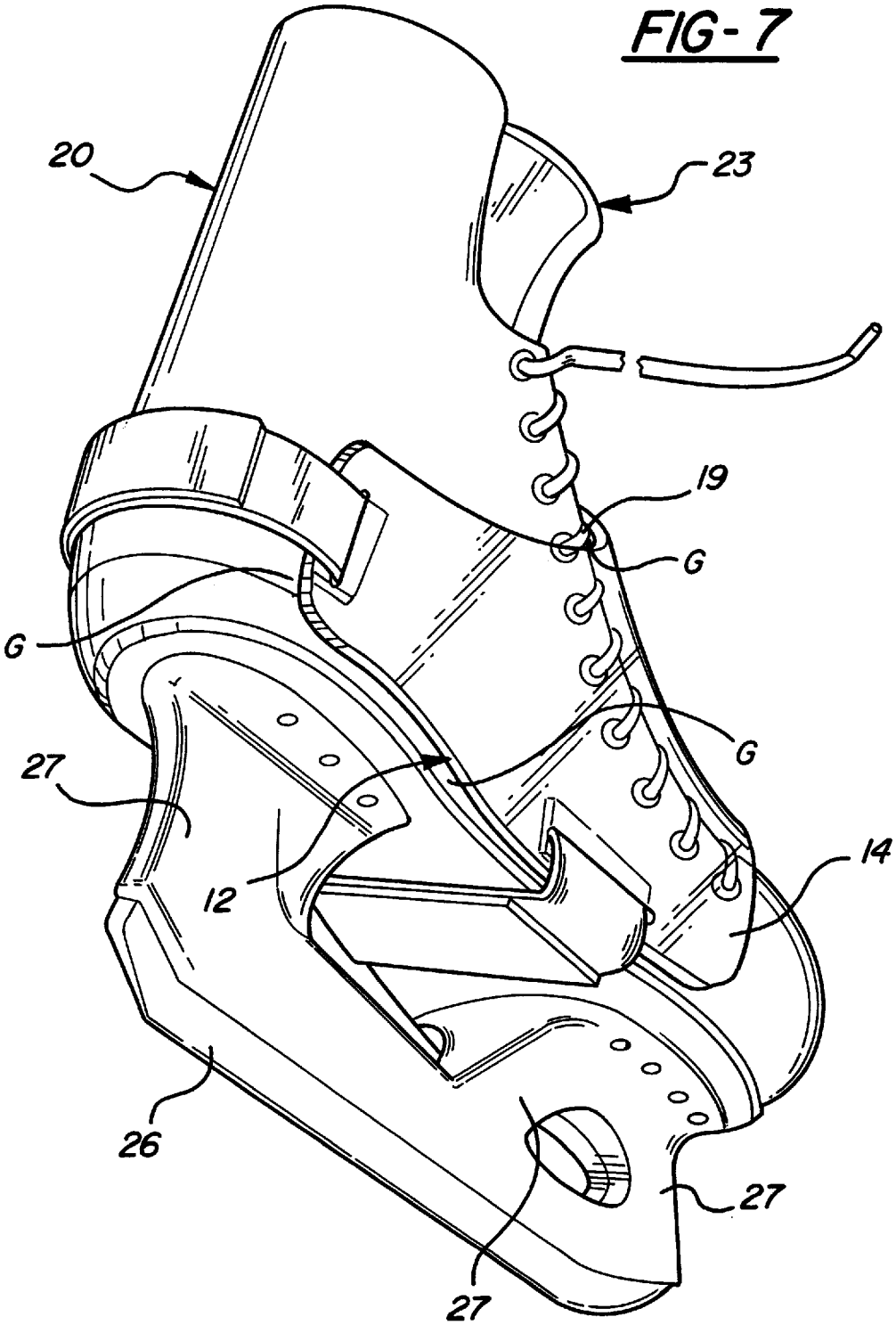
FIG. 7 is a bottom perspective view of an ice hockey skate having the protective cover of the present invention connected thereon detailing the straps located on the skate and the relationship of the protective cover to the ice hockey skate.

The straps 52, 54, 62 and 64 are located, in any appropriate order, in their respective hole 17 such that the respective pad of each strap is located on the inside of the single layer 14 as best shown by the arrows in FIG. 6. Any time during the above procedure, the player puts the skate 20 on and tightens it using the lace 19 as is well known. Next the protective cover 10 is placed on the skate 20 such that the first portion 11 is aligned with the first side 24 of the skate, the second portion 12 is aligned with the second side 25 of the skate 20 and the third portion 13 is aligned with the front, tongue portion 22 of the skate 20. Furthermore, the pads of the straps are located between the single layer 14 and the respective portion of the skate 20 to form the gap G as best shown in FIG. 7.

The straps 52, 54, 62 and 64 are connected accordingly to form the first and second fastener pairs 50 and 60, respectively, in any appropriate order. The first and second fastener pairs 50 and 60 hold the protective cover 10 to the skate 20 as best shown in FIG. 7 to form the gap G nearly everywhere between the respective portions of the single layer 14 and the corresponding portions of the skate 20.

Accordingly, the protective cover 10 is manufactured and assembled to the skate 20 and will protect the player's foot from impacts resulting from pucks and sticks. Additionally, the protective cover 10, once attached to the skate 20, will provide the player with added stability and support. This added support provides the player with an overall "form fit" feel that has been found to have a positive effect upon the skater's performance.

While the invention has been detailed above in the terms of a preferred embodiment, it should be understood by a person of ordinary skill in the art to which the present invention pertains that the invention is not limited to the embodiments described and shown in the accompanying drawings. It should be appreciated by a person of ordinary skill in the art that modifications are possible, particularly with respect to the thickness of the thermoplastic substrate, the attachments, and the variations in manufacturing processes without departing from the present invention. Accordingly, the present embodiments are to be considered illustrative and not restrictive when taken in conjunction with the appended claims.

What is claimed is:

1. A protective cover apparatus for partially covering the foot of a player wearing a hockey skate, said hockey skate having a front portion including a tongue portion, a first side portion and a second side portion, said protective cover apparatus comprising:

a unitary layer having a first portion covering said front portion of said skate; a second portion unitary with said first portion and covering said first side portion of said hockey skate; and a third portion unitary with said first and said second portions and covering said second side portion of said hockey skate, said second and third side portions extending in a direction away from said first side portion to cover the ankle area of said hockey skate; and means for connecting said layer to said skate, said connecting means having a means for creating a gap between said layer and said skate, said means for creating said gap being located between said hockey skate and said second and third portions of said layer such that said protective cover apparatus may be displaced toward said skate by an impact force and partly dissipate such force through said connection means before said layer makes contact with said skate.

2. The protective cover apparatus according to claim 1 further comprising a first aperture; a second aperture oppositely spaced from said first aperture; and wherein said means for connecting further comprises a first strap having a hook material thereon and a second strap having a loop material thereon, and further wherein said means for creating a gap further comprises one end of each said first and second straps being folded over and stitched to constitute a pad, each pad located proximate a respective aperture of said protective cover apparatus such that as said loop material of said second strap wraps over said hook material of said first strap said protective cover apparatus is fastened to said skate, said pads of said straps being located between said protective cover apparatus and said skate to define said gap between said skate and said protective cover apparatus.

3. The protective cover apparatus according to claim 2 further comprising a third aperture; a fourth aperture oppositely spaced from said third aperture; and wherein said connecting means further comprises a third strap having a hook material thereon and a fourth strap having a loop material thereon, wherein one end of each said third and fourth straps is folded over and stitched to constitute a pad, and wherein said opposite ends of said third and fourth straps are inserted through said third and fourth apertures, respectively, such that each pad is located proximate said third and fourth apertures, respectively, of said protective cover apparatus whereby said loop material of said fourth strap wraps over said hook material of said third strap and fastens said protective cover apparatus to said skate, said pads of said straps being located between said protective cover apparatus and said skate to define said gap between said skate and said protective cover apparatus.

4. The protective cover apparatus according to claim 1 wherein said layer is composed of a thermoplastic material.

5. The protective cover apparatus according to claim 4 wherein said thermoplastic material is a clear polycarbonate.

6. A method for assembling a protective cover to a hockey skate, said hockey skate having a front portion including a tongue portion, a first side portion and a second side portion, said method comprising the steps of:

forming a unitary protective layer having a first portion confronting said front portion of said hockey skate; a second portion confronting said first side portion of said hockey skate; a third portion confronting said second side portion of said hockey skate; a first aperture located in said second portion and a second aperture oppositely disposed in said third portion;

forming a first strap having a hook material located on one side thereof;

folding a first end of said first strap and stitching said fold to constitute a pad;

forming a second strap having a loop material located thereon;

folding a first end of said second strap and stitching said fold to constitute a pad;

inserting an opposite end of said first strap through said first aperture in said layer;

inserting an opposite end of said second strap through said second aperture in said layer;

placing said layer containing said first and said second straps on said skate and locating said pads between said layer and said skate to define a gap between said layer and said skate; and folding said hook material of said first strap over said loop material of said second strap to fasten said protective cover to said skate.

* * * * *